United States Patent [19]

Reinle et al.

[11] Patent Number: 4,939,881

[45] Date of Patent: Jul. 10, 1990

[54] REINFORCING APPARATUS FOR A MASONRY WALL, AS WELL AS MASONRY WALL

[75] Inventors: Erwin Reinle, Zurich, Switzerland; Guido Van de Loock, Belsele, Belgium

[73] Assignee: N.V. Bekaert S.A., Zwevegem, Belgium

[21] Appl. No.: 347,635

[22] Filed: May 8, 1989

[30] Foreign Application Priority Data

May 5, 1988 [CH] Switzerland ..... 1725/88

[51] Int. Cl.[5] ..... E04C 1/04

[52] U.S. Cl. ..... 52/565; 52/562; 52/564; 52/437; 52/747

[58] Field of Search ..... 52/565, 563, 564, 562, 52/566, 568, 432, 437, 438, 442

[56] References Cited

U.S. PATENT DOCUMENTS

| | | | |
|---|---|---|---|
| 1,013,038 | 2/1911 | Mitchell | 52/564 |
| 1,962,514 | 6/1934 | MacWilliam | 52/562 X |
| 2,929,238 | 3/1960 | Kaye | 52/562 X |
| 4,167,840 | 9/1979 | Ivany | 52/438 |
| 4,190,999 | 3/1980 | Hampton | 52/565 X |
| 4,263,765 | 9/1981 | Maloney | 52/564 X |
| 4,769,961 | 9/1988 | Gillet | 52/437 X |

FOREIGN PATENT DOCUMENTS

| | | |
|---|---|---|
| 2402653 | 8/1974 | Fed. Rep. of Germany . |
| 3000151 | 7/1981 | Fed. Rep. of Germany . |
| 125649 | 5/1928 | Switzerland . |
| 385502 | 12/1932 | United Kingdom . |
| 1403181 | 8/1975 | United Kingdom . |

*Primary Examiner*—Henry E. Raduazo
*Assistant Examiner*—Creighton Smith
*Attorney, Agent, or Firm*—Foley & Lardner, Schwartz, Jeffery, Schwaab, Mack, Blumenthal & Evans

[57] ABSTRACT

A reinforcing apparatus (8) is fitted in each n-th bed joint (4). The horizontal reinforement (10) of the reinforcing apparatus is embedded in a mortar layer (20) of the bed joint (4). Vertical reinforcing elements (16, 18) of adjacent reinforcing apparatuses (8) are arranged two by two in the vertical recesses (22) of the building stones (2) overlapping each other at least in part and embedded in a mortar mass (26). This way, a horizontally and vertically reinforced masonry wall is obtained, which can be constructed in practice in accordance with the usual method of construction.

20 Claims, 6 Drawing Sheets

REINFORCING APPARATUS FOR A MASONRY WALL, AS WELL AS MASONRY WALL

BACKGROUND OF THE INVENTION

1. Field of the Invention

The invention relates to a reinforcing apparatus for a masonry wall with a horizontal reinforcement to be fitted in a bed joint. Such a reinforcing apparatus or reinforcement product is generally known and is manufactured and sold by the applicant N.V. BEKAERT S.A. under the trademark MURFOR ®-reinforcement product. A special embodiment of such a MURFOR ®-element is described in the German patent 2.402.653.

The invention also relates to a masonry wall reinforced with such new reinforcing apparatuses.

2. Brief Description of the Related Art

Reinforcing is often also called armouring and such reinforcing apparatuses are also known as reinforcing or armouring members.

Although the reinforcement of concrete has been known for a long time, the development of the reinforced masonry wall has dropped far behind with respect to that of reinforced concrete. The causes of this impediment to the development in the masonry-wall construction mainly lie in the ordered stone-mortar structure of the masonry wall, which often obstruct an unrestricted reinforcement adapted to the variation in tensile stress. In the draft of DIN 1053, part 3 published in 1987, a first attempt is made to demonstrate the possibilities of reinforcing a masonry wall. Several possibilities of horizontal reinforcement and vertical reinforcement of masonry walls are described, the vertical reinforcements having a relatively complicated structure. In particular, it is not possible to provide both a horizontal and a vertical reinforcement in a single masonry wall.

If this has to be done, complicated walled-in recesses are required to construct at the same time a vertical and a horizontal reinforcement (DIN 1053, part 3, page 3, FIG. 7).

However, such a reinforcement cannot be effected in normal masonry construction and is limited to special cases. Besides, an even distribution of such a reinforcement over a masonry wall is inconceivable. Furthermore, such a masonry wall is very expensive.

OBJECTS AND SUMMARY OF THE INVENTION

It is the object of the invention to provide a particularly simple reinforcing apparatus for a masonry wall, which makes it possible to manually construct a horizontally and vertically reinforced masonry wall practically without departing from the masonry technique of the prior art.

For this object, the invention provides a reinforcing apparatus of the type mentioned at the outset, characterized in that vertical reinforcing elements which are to be put into vertical recesses of building stones are arranged in at least one vertical direction on the horizontal reinforcement, the height of the vertical reinforcements approximately corresponding to the height of at least two building stones to be laid up.

A masonry wall, which is provided with reinforcing apparatuses according to the invention, is characterized in selected bed pins, i.e. in, that a reinforcing apparatus is fitted in every n-th bed joint, the horizontal reinforcement being embedded in a mortar layer of the bed joint between two building-stone courses and vertical reinforcing elements of adjacent reinforcing apparatuses being arranged two by two in vertical recesses of the building stones overlapping each other at least in part and embedded in a mortar mass.

As vertical reinforcing elements, which are to be put into vertical recesses of building stones and the height H of which approximately corresponds to at least the height of two building stones to be laid up, are arranged in at least one vertical direction on the horizontal reinforcement that is to be fitted in a bed joint, such reinforcing apparatuses can be fitted in the course of the usual manual method of constructing masonry walls. This way, the horizontal reinforcements are embedded in a mortar layer of a bed joint and the building stones are slipped over the vertical reinforcing elements and/or the latter are introduced into vertical recesses of building stones, depending on the direction in which the vertical reinforcing elements are fitted. Then, the vertical recess only needs to be filled with a mortar mass. The arrangement is carried out in such a way that vertical reinforcing elements of two adjacent reinforcing apparatuses are arranged two by two in the vertical recesses overlapping each other at least in part and embedded in the mortar mass. Although the vertical reinforcing elements extend vertically only over a limited height, a bond is obtained between adjacent vertical reinforcing elements due to the two-by-two overlapping arrangement in the recess and the embedment in the mortar mass, the result of which corresponds to that of a vertical continuous reinforcement.

Advantageous embodiments of the reinforcing apparatus according to the invention are described in claims 1 to 10 and advantageous embodiments of the masonry wall are described in claims 11 to 20.

Basically, it is possible to build the reinforcing apparatus in such a way that the vertical reinforcing elements are arranged on the horizontal reinforcement in one vertical direction only. This embodiment makes it easier to stack the reinforcing apparatus for storage and transport, but it certainly makes the laying of building stones more difficult as these have to be lifted higher and have to be slipped over the vertical reinforcing elements. It is also difficult to introduce such vertical reinforcing elements into the partly filled recesses of the building stones of several courses. An embodiment, whereby the vertical reinforcing elements are arranged on the horizontal reinforcement and are directed in both directions, is therefore more advantageous, as the total height of the vertical reinforcing elements is then distributed over two directions, so that when fitting the reinforcing apparatus on a bed joint, the downwards pointing reinforcing elements are put into vertical recessses of building stones already laid up. Then, only reinforcing elements with half the total height, over which the building stones are to be slipped, still jut out upwards.

A particular embodiment of the reinforcing apparatus is characterized in that the horizontal reinforcement has at least two horizontal reinforcing irons, which are connected to each other by means of cross-connections, to which the vertical reinforcing elements are attached. A further embodiment of the reinforcing apparatus is characterized in that the horizontal reinforcement has at least two horizontal reinforcing irons, which are connected to each other by means of zigzag running cross-connections, whereby the vertical reinforcing elements are attached to the horizontal reinforcing irons.

Preferably the vertical reinforcing elements are U-shaped brackets. The bond or connection between the vertical reinforcing elements that are to be arranged two by two is considerably improved by U-shaped vertical reinforcing elements or bracket. In the embodiment of the reinforcing apparatus, whereby the brackets are arranged under an oblique angle with respect to the horizontal reinforcing irons, the stackability of the reinforcing apparatuses for storage and transport is considerably improved.

In the embodiment of the reinforcing apparatus, whereby the width B of the U-shaped vertical reinforcing elements or brackets approximately corresponds to the distance A between the horizontal reinforcing irons, the reinforcement is moved towards the peripheral areas of the masonry wall and this certainly requires building stones with wider vertical recesses.

In case, the width B1 of the U-shaped vertical reinforcing elements corresponds to not more than half the distance A between the horizontal reinforcing irons, then smaller recesses in the building stone will suffice, whereby the reinforcement then suitably concentrates on the vertical centre plane of the masonry wall.

Preferably the U-shaped vertical elements or brackets are provided with a bulge or protruding part. The brackets are connected to the horizontal reinforcing elements at the bulge or protruding part by means of welding joints.

An advantageous embodiment of the masonry wall according to the invention, when using large building stones, is characterized in that the reinforcing apparatuses are fitted in every bed joint (n=1) and in that the height (H) of the vertical reinforcing elements approximately corresponds to twice the height (h) of a building stone. In case the masonry wall is built up of smaller building stones, such as common bricks, then the embodiment of the masonry wall is characterized in, that reinforcing apparatuses are fitted in every second bed joint (n=2) and in that the height (H) of the vertical reinforcing elements corresponds to at least three times the height ($h_1$) of a building stone.

The masonry wall can be characterized in that the vertical recesses of the building stones receiving the vertical reinforcing elements are formed at half the length of the building stones and on the lateral end faces of the building stones. Higher strength values are obtained with an embodiment of the masonry wall, whereby the vertical recesses receiving the vertical reinforcing elements are each time located at a distance of ¼ from the lateral end faces of the building stones.

With the new reinforcing apparatus, masonry walls can be constructed which have a calculable tensile strength and a higher static load taking capacity and which stand out because of improved resistance against cracks and earthquakes.

BRIEF DESCRIPTION OF THE DRAWINGS

Exemplary embodiments of the invention will hereinafter be described in detail with reference to the drawings, in which.

DETAILED DESCRIPTION OF PREFERRED EMBODIMENT

Figure 1:
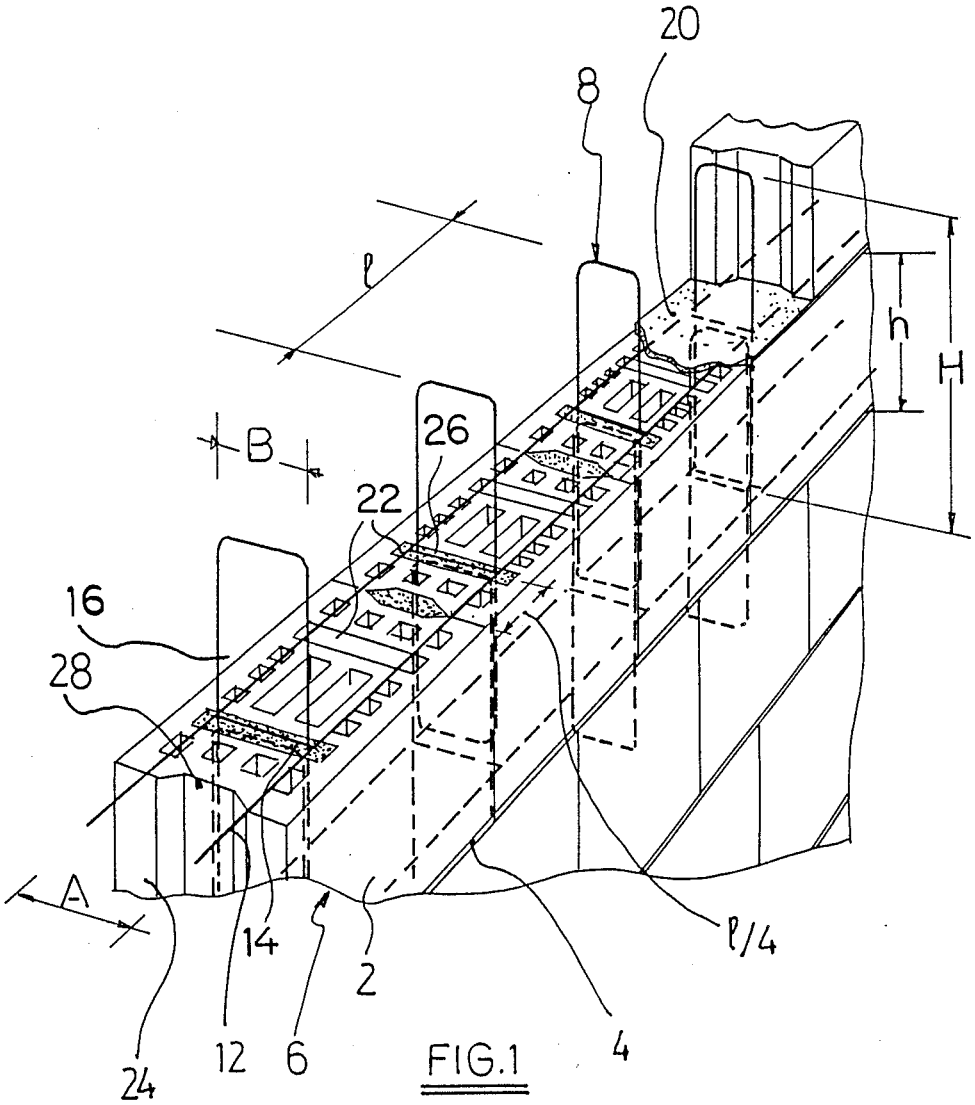
FIG. 1 is a schematic representation of part of a masonry wall with a reinforcing apparatus with wide vertical reinforcing elements.

FIG. 1 shows a part of a masonry wall, which is built up of large-sized building stones 2 in normal stretching bond. Reinforcing apparatuses 8 are fitted in the bed joint 4 between the courses 6 of the building stones 2. Each of these reinforcing apparatuses consists of a horizontal reinforcement 10, which has two parallel running reinforcing irons 12; which are connected by a cross-connection 14. The reinforcing irons 12 and the cross-connections 14 lie in one plane.

Vertical reinforcing elements 16, 18 are attached to the cross-connection 14, the reinforcing element 16 pointing up and the reinforcing element 18 pointing down. These reinforcing elements are U-shaped bracket and have a width B, which corresponds to the distance A between the reinforcing irons 12 of the horizontal reinforcement 10. In the present example, the total height H of the reinforcing elements corresponds to approximately twice the height h of a building stone 2. Suitably, the total height H is chosen so that the vertical reinforcing elements leave such a distance from a bed joint, that the mortar of the bed joint penetrating into the recess does not hinder the introduction of the vertical reinforcing element into such a recess. The vertical reinforcing elements 16, 18 are protruding upward and downward with repsect to the plane through the horizontal reinforcement over a distance, which substantially corresponds to the distance between two adjacent bed joints 4 of the masonry wall.

The horizontal reinforcement 10 is embedded in the mortar layer 20 of a bed joint 4. The downwards pointing vertical reinforcing elements 18 are put into vertical recesses 22 of the building stones 2. These vertical recesses 22 are each time located at a distance of a fourth of the length 1 of the building stone from its end faces 24. As further appears from FIG. 1, the upwards pointing reinforcing elements 16 of the reinforcing apparatus 8 fitted in the last bed Joint 4 also extend each time into the vertical recesses 22. So, the upwards pointing reinforcing elements 16 of the last bed joint 4 lie two by two with the downwards pointing reinforcing elements 18 of the adjacent bed joint in the vertical recess 22 and are there embedded in a mortar mass 26. This arrangement creates a bond between the reinforcing elements 16, 18 in the vertical recess 22, so that the reinforcing elements 16, 18, which in themselves only have a limited height, act as a vertical armouring or reinforcement which extends over the whole wall height.

The manufacture of the masonry wall is extremely simple, as the separate building stones in the bottom course are joined together in the normal way, whereupon is fitted the reinforcing apparatus, which can have a length of from 2 to 4 meter for instance. To this end, the downwards pointing reinforcing elements 18 are introduced so far into the vertical recesses 22 until the horizontal reinforcement 10 rests upon the upper bed-surface of the building-stone course. After that, the vertical recesses 22 are filled with mortar mass 26 and the mortar layer 20 is applied to the upper bed-surface and hence to the horizontal reinforcement 10, until the latter is embedded in the mortar layer. Now, the following course of building stones 2 can be laid, their vertical recesses being slipped over the upwards pointing reinforcing elements 16, so that an appropriate staggering of the building stones is obtained with respect to the preceding course of building stones. After that, the reinforcing apparatus 8 is placed upon the new course of building stones, the downwards pointing reinforcing elements 18 being put into those vertical recesses of the building stones 2, in which has already been fitted the upwards pointing reinforcing elements 16 of the preceding reinforcing apparatus 8. After that, the vertical recesses 22 are filled with the mortar mass 26 and the mortar layer 20 is applied to the bed surface. The further building of the wall continues in an analogous way.

Figure 2:
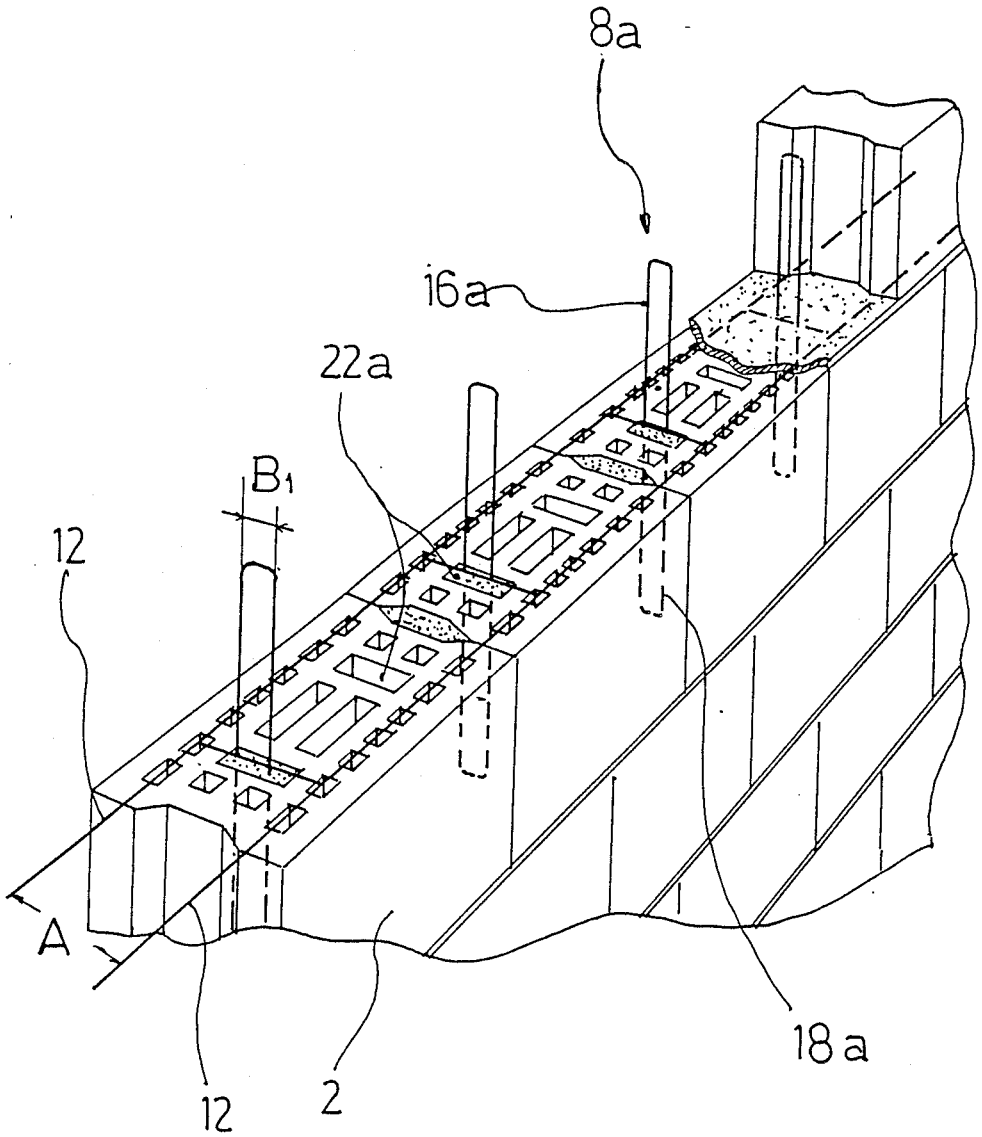
FIG. 2 represents a masonry wall in accordance with the representation of FIG. 1, with a reinforcing apparatus with narrow vertical reinforcing elements.

FIG. 2 again shows part of a masonry wall with reinforcing apparatuses **8*a*, the same parts again being provided with the same reference marks. In the case of FIG. 2, the vertical reinforcing elements 16*a*, 18*a* have a width $B_1$, which is smaller than half the distance A between the reinforcing irons 12. Correspondingly, the vertical recesses 22*a* in the building stone 2 are also less wide than in the exemplary embodiment of FIG. 1. This causes the vertical reinforcement to concentrate in the horizontal centre plane of the masonry wall and the strength of the building stone in the peripheral areas is increased by the less wide recesses 22*a***.

Figure 3:
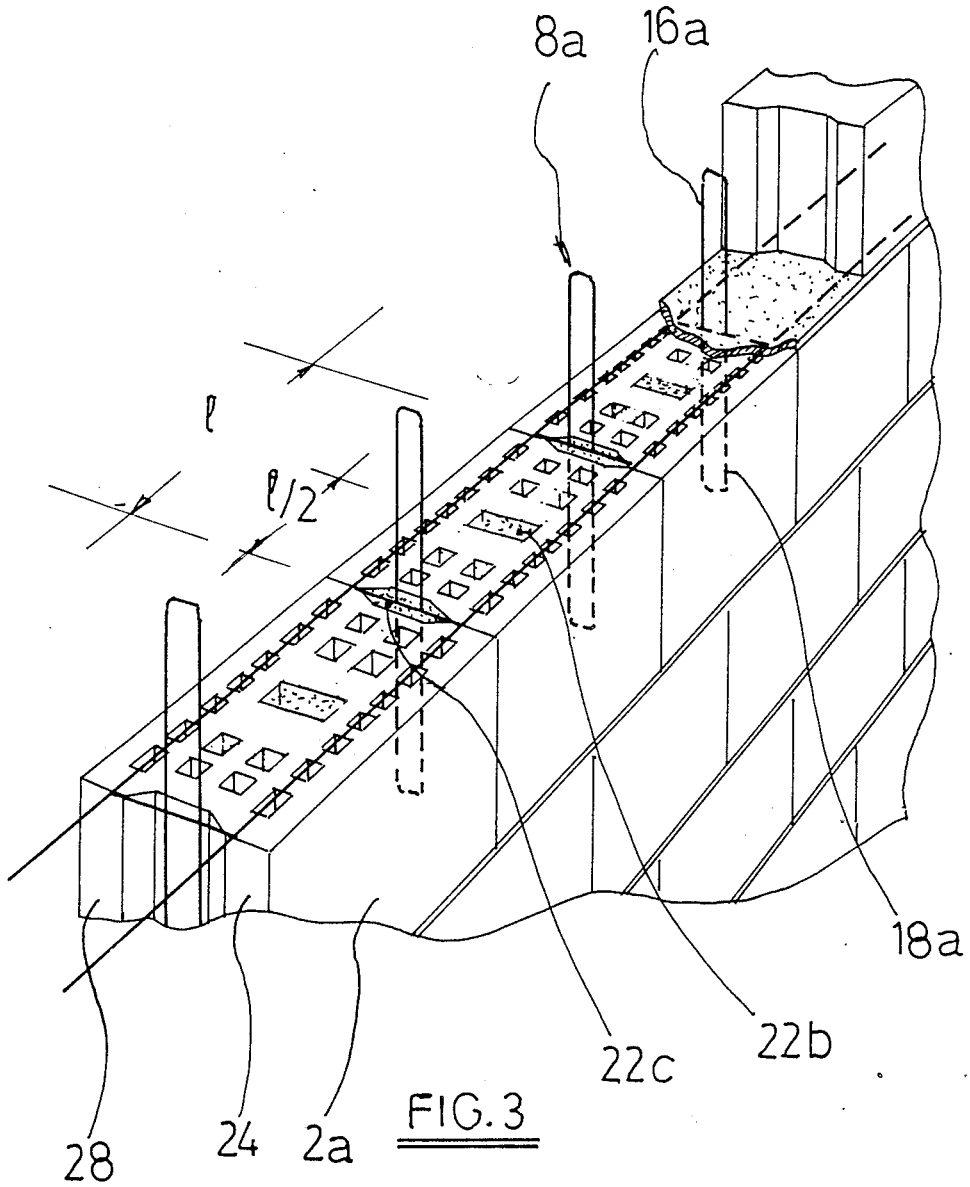
FIG. 3 represents a masonry wall in accordance with the representation of FIG. 2, with a modified arrangement of the vertical recesses of the building stones.

FIG. 3 shows another part of a masonry wall, which corresponds to the one of FIG. 2, but where the vertical recesses **22*b* and 22*c* differ from those of FIG. 2. The vertical recesses 22*b* are located at half the length L of the building stone 2*a* and the vertical recesses 22*c* are formed by grooves 28 in the end faces 24 of building stones 2*a* laid end-to-end. As a result, the vertical reinforcing elements lie alternately in vertical recesses 22*b* and 22*c*. This measure further simplifies the construction of the masonry wall, whereby a certain weakening due to the location of the vertical recess 22*c*** in the butt joints of building stones laid end-to-end has to be accepted, however.

Figure 4:
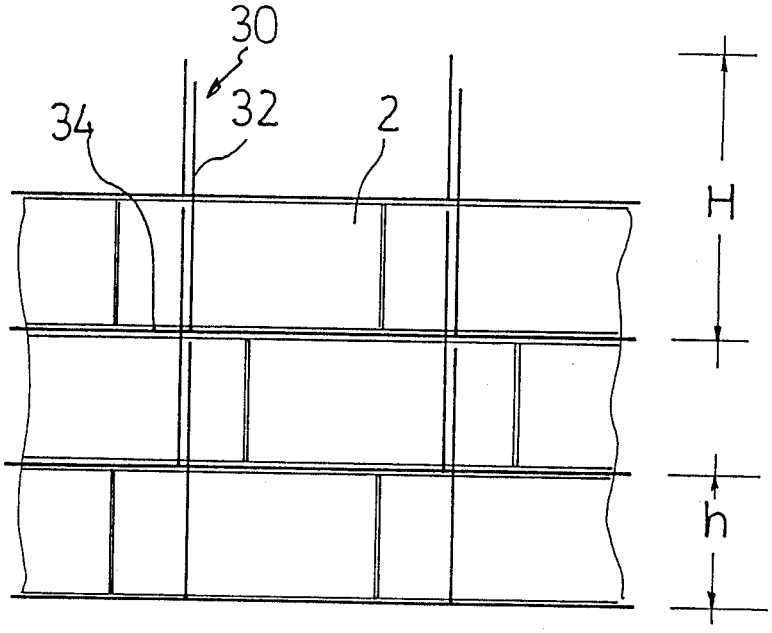
FIG. 4 represents part of a masonry wall, in a front view of the wall face, with large building stones and vertical reinforcing elements that are twice as high as the stones.

FIG. 4 shows part of another masonry wall, in a front view of the wall face of the masonry wall, where the reinforcing apparatus 30 only presents one type of vertical reinforcing elements 32, which are attached to the horizontal reinforcement 34. These vertical reinforcing elements 32 have a total height H, which again corresponds to approximately twice the height h of a building stone 2. Unlike the masonry walls of the FIGS. 1 to 3, the vertical reinforcing elements in the case of the masonry wall of FIG. 4 are usually not put into vertical recesses of an underlying building stone, but the building stones are each time slipped and laid over the vertical reinforcing elements 32. It is also possible, though, to provide the reinforcing apparatus 30 with downwards pointing vertical reinforcing elements 32, but the reinforcing apparatuses cannot be fitted then until the building-stone courses have been laid up. In this case, the vertical reinforcing elements have to be introduced from above into the vertical recesses of the building stones.

Figure 5:
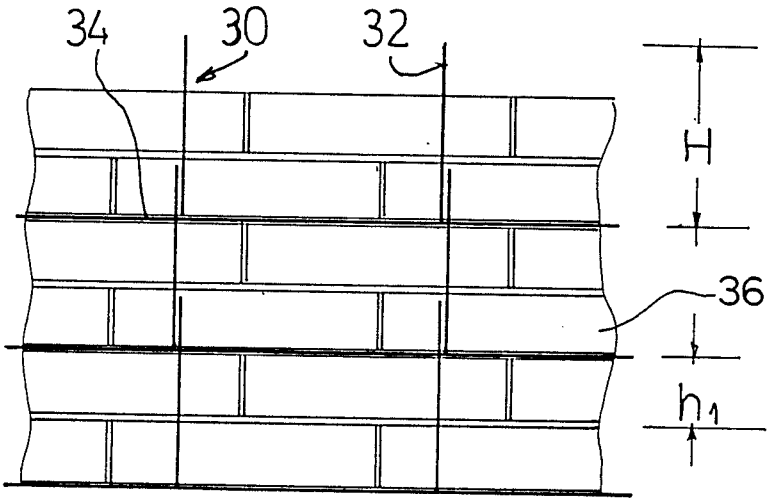
FIG. 5 represents part of a masonry wall, in a front view of the wall face, with small building stones and vertical reinforcing elements that are three times as high as the stones.

FIG. 5 shows a part of a masonry wall with reinforcing apparatuses 30 that are analogous to those of FIG. 4, where smaller building stones 36, i.e. common bricks, are laid up, however, and where the reinforcing apparatus is only fitted in every second building-stone course. The total height H of the reinforcing elements 32 can correspond to approximately three or four times the indicated height $h_1$ of a building stone 36. In the first case, the vertical reinforcing elements only combine, i.e. overlap, over $\frac{2}{3}$ of the height H of the vertical reinforcing elements.

Figure 6:
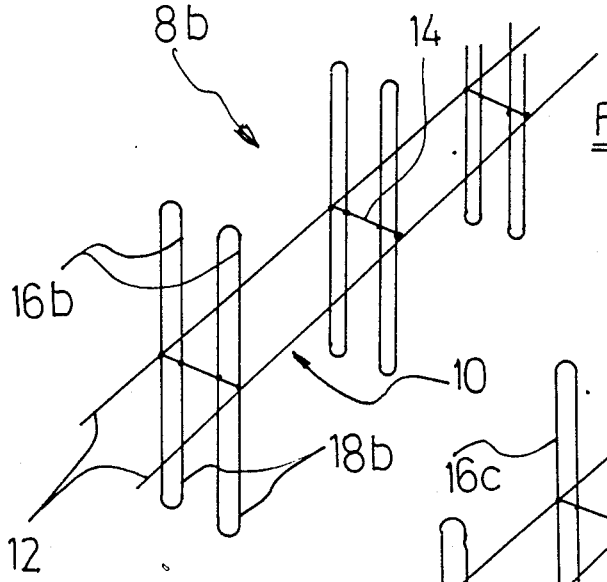
FIG. 6 is a schematic representation of another reinforcing apparatus.

FIG. 6 shows a reinforcing apparatus **8*b* that is built in a similar way as the reinforcing apparatus 8*a* of the FIGS. 2 and 3, where, however, per cross-connection 14 between the reinforcing elements 12 of the horizontal reinforcement 10 two vertical reinforcing elements 16*b* and 18*b*** are each time arranged two by two upwards and downwards. In the case of such a reinforcing apparatus, the reinforcement is moved to the peripheral layers of the masonry wall.

Figure 7:
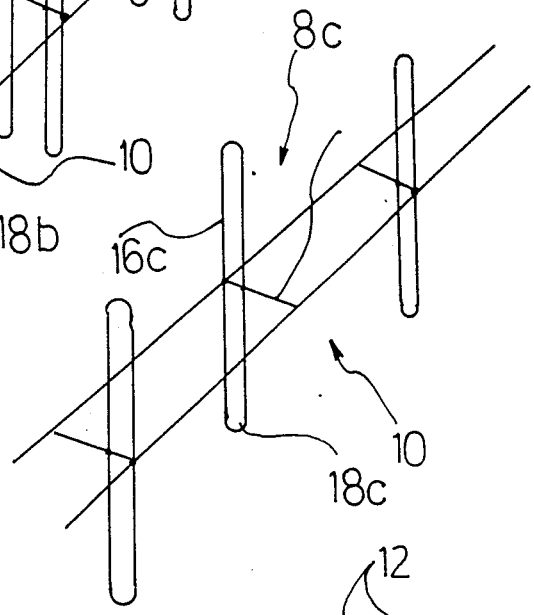
FIG. 7 is a schematic representation of another reinforcing apparatus.

FIG. 7 shows another reinforcing apparatus **8*c*, the vertical reinforcing elements 16*c*, 18*c*, respectively, of which are arranged shifted sideways from cross-connection 14 to cross-connection 14 with respect to the centre plane. As a result, an improved vertical reinforcement is also obtained in the peripheral areas of the masonry wall, which is, however, less effective than the reinforcing apparatus in accordance with FIG. 6**, but which uses less material for it.

Figure 8:
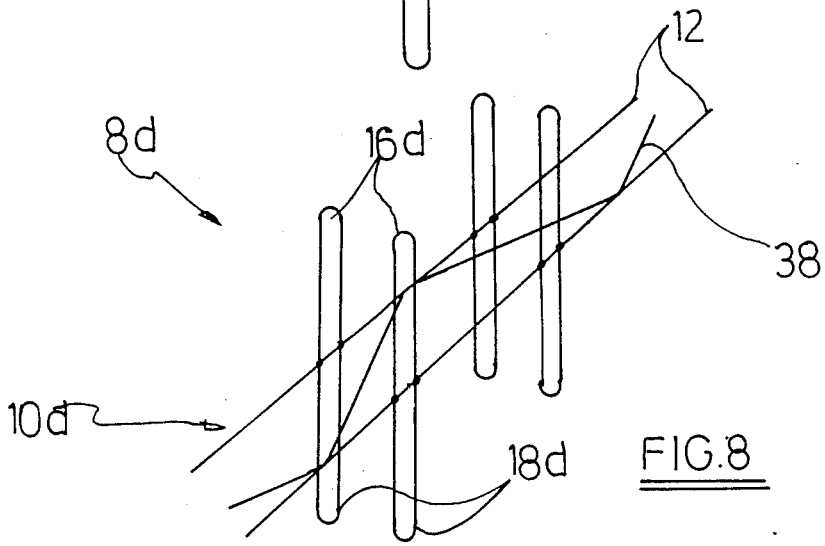
FIG. 8 is a schematic representation of another reinforcing apparatus.

FIG. 8 shows another reinforcing apparatus **8*d*, the horizontal reinforcement 10*d* of which has two longitudinally extending reinforcing irons 12, which are interconnected by zigzag running cross-connections 38. U-shaped vertical reinforcing elements or brackets 16*d*, 18*d* are attached to the outside or inside face of the horizontal reinforcing irons 12**. If necessary, additional cross-connections can be fitted at right angles between the reinforcing irons near the vertical reinforcing elements.

Figure 9:
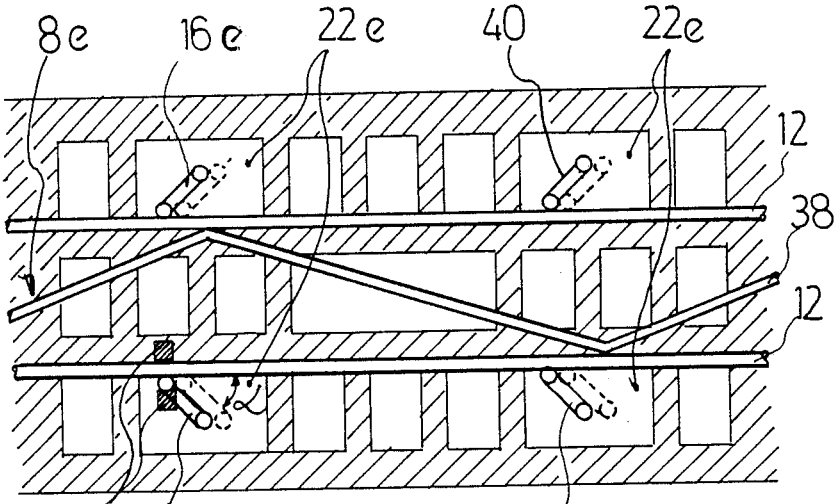
FIG. 9 shows a cross-section of part of a masonry wall, whereby the vertical reinforcing elements are welded to the horizontal reinforcement under an oblique angle.

FIG. 9 shows a cross-section of a part of a masonry wall, whereby still another reinforcing apparatus **8*e* is used. This reinforcing apparatus 8*e* corresponds approximately to the reinforcing apparatus 8*d*, shown in FIG. 8; but the vertical reinforcing elements 16*e*, 18*e*, which are U-shaped brackets 40, are situated obliquely with respect to the horizontal reinforcing irons 12. These brackets 40 form an angle $\alpha$ with the reinforcing irons 12 in the cross-section, shown in FIG. 9. As can be seen in FIG. 8, the U-shaped vertical reinforcing elements or bracket 16*d*, 18*d* are parallel to the horizontal reinforcing irons 12**.

A first advantage of the reinforcing apparatus **8*e*, shown in FIG. 9, is, that only one welding point is needed for attaching or connecting a bracket 40 to a horizontal reinforcing iron 12. FIG. 9 shows schematically the welding electrodes 42 for connecting a bracket 40 to a horizontal reinforcing iron 12**.

Figure 10:
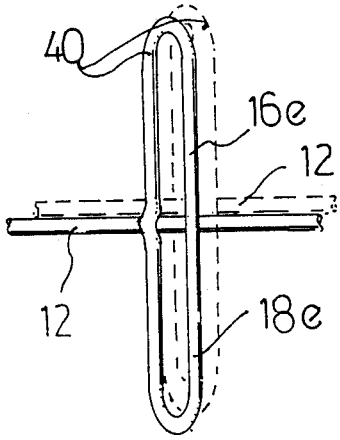
FIG. 10 shows part of two stacked reinforcing apparatuses according to FIG. 9.
Figure 11:
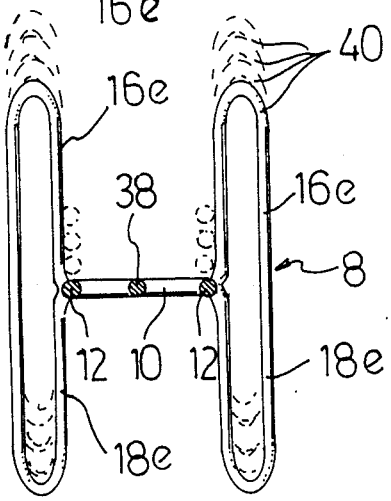
FIG. 11 shows a cross-section through four stacked reinforcing apparatuses according to FIG. 9.

A second advantage of the reinforcing apparatus 8e, shown in FIGS. 9, 10 and 11, is, that a great number of these reinforcing apparatuses 8e can easily be stacked, which is advantageous for lowering the transport costs.

Figure 12:
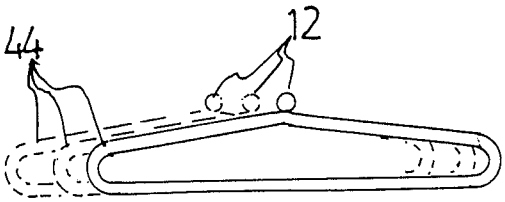
FIG. 12 shows part of three stacked reinforcing apparatuses.

FIG. 12 shows another embodiment of the bracket. The vertical reinforcing elements, shaped as a bracket 44, show a bulge or protruding area for improving the welding connection of this bulge or protruding area to the adjacent reinforcing iron 12.

During the welding operation of a bracket 40, 44 to the adjacent or corresponding reinforcing iron 12, it is possible that this bracket 40, resp. 44 is pressed into the reinforcing iron 12; which leads to serious problems for stacking these reinforcing apparatuses or makes stacking of these apparatuses impossible. Therefore it can be necessary to weld a small distance holder between the bracket 40, resp. 44 and the adjacent or corresponding reinforcing iron 12, so that the reinforcing iron remains completely free. The stackability of these reinforcing apparatuses is then improved.

It is possible to think of numerous other exemplary embodiments.

In the examples shown, there is each time one pair of vertical reinforcing elements available per building stone. In case of higher loads, it is also possible that two pairs of vertical reinforcing elements are provided per building stone. In case of lower load requirements on the other hand, it is possible that only every n-th building stone of a building-stone course is provided with such a vertical reinforcement.

The vertical reinforcing elements can also be simple straight bars or can have a widening of the cross-section at the free ends, ending in a hook for instance.

The reinforcing apparatuses can be made in accordance with the usual guidelines for reinforcements, i.e. be made corrosion-resistant, either consisting of corrosion-resistant material or being provided with an appropriate coating. The latter can be made of zinc or synthetic material for instance. The separate components of the reinforcing apparatus can be made of round or flat material and can have an appropriate, profiled surface that is usual for reinforcing irons. Suitably, the bars of the reinforcement have a relatively small cross-section of from 4 to 8 mm for instance. If necessary, it is also possible to utilize thicker bars of up to 15 mm for instance. Moreover, it is possible to make the separate elements of the reinforcing apparatus out of bars of different diameters, the vertical reinforcing elements having a larger cross-section than the horizontal ones. All the elements or components of the reinforcing apparatus are preferably made of steel and connected to each other by welding joints.

The recesses in the building stones which are used for receiving the vertical reinforcing elements, can have a certain extension longitudinally of the building stone so that a building stone the end face of which is provided with mortar can be laid laterally thereof.

List of Reference Marks

A—Distance between the reinforcing irons
B—Width of the vertical reinforcing elements
$B_1$—Width of the vertical reinforcing elements
H—Total height of the vertical reinforcing elements
h—Height of the building stone
$h_1$—Height of the building stone
1—Length of the building stone
2—Building stone
2a—Building stone
4—Bed joint
6—Course
8—Reinforcing apparatus
8a—Reinforcing apparatus
8b—Reinforcing apparatus
8c—Reinforcing apparatus
8d—Reinforcing apparatus
8e—Reinforcing apparatus
10—Horizontal reinforcement
10d—Horizontal reinforcement
12—Reinforcing iron
14—Cross-connection
16—Vertical reinforcing element
16a—Vertical reinforcing element
16b—Vertical reinforcing element
16c—Vertical reinforcing element
16d—Vertical reinforcing element
16e—Vertical reinforcing element
18—Vertical reinforcing element
18a—Vertical reinforcing element
18b—Vertical reinforcing element
18c—Vertical reinforcing element
18d—Vertical reinforcing element
18e—Vertical reinforcing element
20—Mortar layer
22—Vertical recess
22a—Vertical recess
22b—Vertical recess
22c—Vertical recess
22e—Vertical recess
24—End face
26—Mortar mass
28—Groove
30—Reinforcing apparatus
32—Vertical reinforcing element
34—Horizontal reinforcement
36—Building stone
38—Cross-connection
40—Bracket
42—Welding electrode
44—Bracket

We claim:

1. Reinforcing apparatus for a masonry wall made of a plurality of building stones having vertical recesses therein, comprising:

(a) a horizontal reinforcement for placement in a bed joint;

(b) a plurality of paired vertical reinforcement elements in overlapping relationship for placement into the vertical recesses, the vertical reinforcing elements having a height corresponding approximately to the height of at least two building stones.

2. Reinforcing apparatus according to claim 1, wherein one vertical reinforcing element extends upward and above the horizontal reinforcement, and the other vertical reinforcing element extends downward and below.

3. Reinforcing apparatus according to claim 1, wherein the horizontal reinforcement comprises at least two horizontal reinforcing irons connected to each other by means of cross-connections, the cross-connections also being attached to the vertical reinforcing elements.

4. Reinforcing apparatus according to claim 1, wherein the horizontal reinforcement comprises at least two horizontal reinforcing irons connected to each other and to the vertical reinforcing elements by means of zigzag cross-connections.

5. Reinforcing apparatus according to claim 3, wherein the vertical reinforcing elements are U-shaped brackets.

6. Reinforcing apparatus according to claim 5, wherein the brackets are arranged at an oblique angle to the horizontal reinforcing irons.

7. Reinforcing apparatus according to claim 5, wherein the width of the brackets corresponds approximately to the distance between the horizontal reinforcing irons.

8. Reinforcing apparatus according to claim 5, wherein the width of the brackets is equal to less than half the distance between the horizontal reinforcing irons.

9. Reinforcing apparatus according to claim 5, wherein the brackets are provided with a bulge and the brackets are connected at the bulge to the horizontal reinforcing irons by means of a weld joint.

10. A reinforced longitudinal masonry wall comprising:

(a) a first plurality of building stones having vertical recesses therein positioned end-to-end to form the masonry wall;

(b) a mortar layer on the bulding stones in the longitudinal direction;

(c) a horizontal reinforcement embedded in the mortar layer;

(d) a second plurality of building stones positioned end-to-end on the mortar layer thereby forming a bed joint;

(e) a plurality of paired vertical reinforcing elements in an overlapping relationship positioned in the vertical recesses.

11. A masonry wall according to claim 10, wherein the horizontal reinforcement is embedded in every bed joint and the height of the vertical reinforcing elements is approximately equal to twice the height of a building stone.

12. A masonry wall according to claim 10, wherein the horizontal reinforcement element is embedded in every second bed joint and the height of the vertical reinforcing elements is equal to at least three times the height of a building stone.

13. A masonry wall according to claim 10, wherein the vertical recesses are positioned on a longitudinal end face of the building stones at a distance equal to one half the length of the building stone.

14. A masonry wall according to claim 10, wherein the vertical recesses are positioned on a longitudinal end face of the building stone at a distance equal to one quarter the length of the building stone.

15. A method of reinforcing a masonry wall comprising:

(a) providing a first plurality of building stones end-to-end to form the masonry wall, (b) placing a mortar layer on the building stones in a longitudinal direction, (c) embedding a horizontal reinforcement in the mortar layer, (d) placing a second plurality of building stones end-to-end on the mortar layer, thereby forming a bed joint, (e) inserting a plurality of paired vertical reinforcing elements in overlapping relationship into the vertical recesses in the building stones.

16. A method of reinforcing a masonry wall according to claim 15, wherein the vertical reinforcing elements are U-shaped, and placing one element directed upwardly and the other being directed downwardly.

17. Method of reinforcing a masonry wall according to claim 15, including embedding the horizontal reinforcement in every bed joint, and wherein the height of the vertical reinforcing elements is approximately equal to twice the height of a building stone.

18. Method of reinforcing a masonry wall according to claim 15, including embedding the horizontal reinforcement element in every second bed joint, and wherein the height of the vertical reinforcing elements is equal to at least three times the height of a building stone.

19. Method of reinforcing a masonry wall according to claim 15, including positioning the vertical recesses on a longitudinal end face of the building stones at a distance equal to one half the length of a building stone.

20. Method of reinforcing a masonry wall according to claim 15, including positioning the vertical recesses on a longitudinal end face of the building stone at a distance equal to one quarter the length of a building stone.

* * * * *

UNITED STATES PATENT AND TRADEMARK OFFICE

CERTIFICATE OF CORRECTION

PATENT NO. : 4,939,881
DATED : July 10, 1990
INVENTOR(S) : Erwin Reinle et al.

It is certified that error appears in the above-identified patent and that said Letters Patent is hereby corrected as shown below:

Title page,
Item [22], Filed, please delete "May 8, 1989" and insert -- May 5, 1989 --.

Signed and Sealed this

First Day of July, 2003

JAMES E. ROGAN
*Director of the United States Patent and Trademark Office*